US009657701B2

(12) United States Patent
Kato

(10) Patent No.: US 9,657,701 B2
(45) Date of Patent: May 23, 2017

(54) FUEL INJECTION NOZZLE

(71) Applicant: DENSO CORPORATION, Kariya, Aichi-pref. (JP)

(72) Inventor: Masaaki Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/802,403

(22) Filed: Jul. 17, 2015

(65) Prior Publication Data

US 2016/0025057 A1 Jan. 28, 2016

(30) Foreign Application Priority Data

Jul. 24, 2014 (JP) ..... 2014-151267

(51) Int. Cl.
*F02M 61/18* (2006.01)

(52) U.S. Cl.
CPC .... *F02M 61/1886* (2013.01); *F02M 61/1833* (2013.01); *F02M 61/1846* (2013.01); *F02M 61/1893* (2013.01)

(58) Field of Classification Search
CPC .. F02M 61/18; F02M 6/1833; F02M 61/1846; F02M 61/1886; F02M 61/1893
USPC ..... 239/548, 533.12
See application file for complete search history.

(56) References Cited

U.S. PATENT DOCUMENTS 4,069,978 A * 1/1978 El Moussa ..... F02M 61/1806 219/121.13
4,073,436 A 2/1978 Behr
4,483,482 A 11/1984 Junger et al.
5,934,571 A * 8/1999 Schmidt ..... F02M 45/083 239/533.12
6,427,932 B1 * 8/2002 Danckert ..... F02M 61/18 123/467
6,644,565 B2 * 11/2003 Hockenberger ... F02M 61/1833 239/533.12
7,059,543 B2 6/2006 Dushkin et al.
7,360,722 B2 * 4/2008 Stockner ..... F02M 61/1873 239/533.12
2001/0025892 A1 * 10/2001 McCoy ..... F02B 43/00 239/589
2004/0124269 A1 7/2004 Dushkin et al.
2007/0040053 A1 * 2/2007 Date ..... F02M 61/1846 239/533.2
2008/0105767 A1 * 5/2008 Fujii ..... F02M 61/1846 239/533.2
2009/0020633 A1 * 1/2009 Limmer ..... F02M 61/1806 239/533.12
2011/0030635 A1 2/2011 Siuchta et al.
2012/0000996 A1 * 1/2012 Kobayashi ..... F02M 57/04 239/584

(Continued)

FOREIGN PATENT DOCUMENTS

JP 2012-145048 8/2012

*Primary Examiner* — Darren W Gorman
(74) *Attorney, Agent, or Firm* — Nixon & Vanderhye P.C.

(57) ABSTRACT

A Laval shape is formed between the nozzle seat surface and needle tip portion. An injection hole also has the Laval shape. When the needle lift amount is small, a fuel flow velocity reaches an acoustic velocity in valve-opening portion. The fuel flow velocity further accelerated to a supersonic velocity at the Laval shape. When the needle lift amount is large, the fuel flows into the injection hole without a velocity decrease. Thus, the fuel flow velocity reaches the supersonic velocity at the Laval shape.

9 Claims, 3 Drawing Sheets

(56) References Cited

U.S. PATENT DOCUMENTS

| | | | | |
|---|---|---|---|---|
| 2015/0251277 | A1* | 9/2015 | Marchione | F02M 61/18 239/533.2 |
| 2015/0377200 | A1* | 12/2015 | Abe | F02M 61/18 239/562 |

* cited by examiner

FUEL INJECTION NOZZLE

CROSS-REFERENCE TO RELATED APPLICATION

This application is based on Japanese Patent Application No. 2014-151267 filed on Jul. 24, 2014, the disclosure of which is incorporated herein by reference.

TECHNICAL FIELD

The present disclosure relates to a fuel injection nozzle which can inject "gas fuel" or "liquefied gas fuel at supercritical state". In the following description, a lift-up direction of a needle is referred to "Up-direction", and a lift-down direction of the needle is referred to "Down-direction". The up-down direction does not indicate the gravity direction.

In a case that liquefied gas fuel at supercritical state is injected from a nozzle hole, it is preferable that the fuel is at liquid phase in a clearance between the nozzle body and the needle. After the fuel passed through the clearance, the fuel is brought into the supercritical state. The clearance between the nozzle body and the needle is referred to as a valve opening portion.

BACKGROUND

As a preferable example of liquefied gas fuel, dimethyl ether (DME) is used as the fuel of an internal combustion engine.

Since the heat generation rate of the liquid DME is lower than that light oil, it is necessary to increase the injection quantity of DME more than that the light oil. Thus, in a case that the liquid DME is injected, the injection period and combustion period are extended. As a result, especially, when an engine speed is high, the performance of the DME may be less than the light oil.

By heating the liquid DME, the liquid DME is brought into the supercritical state. The mixture of the supercritical DME and the air is promoted. Thus, while the injection period is long, the combustion period can be shortened.

Furthermore, by injecting the DME at the supercritical state, the injection rate and a heat generating rate become homothetic. Thus, the combustion characteristics can be controlled by the injection rate.

Since the combustion characteristics can be controlled by the injection rate, it is unnecessary to perform a multi-stage injection. Moreover, by injecting the DME at the supercritical state, it can be restricted that the fuel pressure becomes excessively high, as compared with a case where the liquid phase DME is injected.

(Issue 1)

The supercritical fluid can cause the same flow as gas. Thus, when the DME is injected from the nozzle hole at the supersonic velocity, the mixture of the DME and the air can be promoted.

When the lift amount of a needle is small (small lift), the valve opening portion functions as a throttle, so that flow velocity of the fuel reaches acoustic velocity at the valve opening portion.

In a case that a nozzle seat surface and a tip end of the needle are conic surfaces, the clearance between the nozzle seat surface and the tip end of the needle becomes gradually large in a fuel flow direction. In such a shape, the fuel flow of acoustic velocity will be choked and the fuel amount is decreased. Especially, when the lift amount of the needle is very small, the velocity variation (pressure variation) is generated between upstream and downstream of the valve opening portion, which causes a large energy loss.

The flow velocity of the fuel passed through between the nozzle seat and the tip end of the needle is further accelerated in the sack chamber. Then, the fuel flows into the nozzle hole. Further, the fuel pressure is recovered in the nozzle hole and is accelerated. However, the fuel velocity does not reach acoustic velocity.

That is, when the needle lift amount is small, the flow velocity does not reach the acoustic velocity.

(Issue 2)

When the needle lift amount is large, the valve opening portion and the sack chamber function as a fuel passage so that the fuel flow is not attenuated.

However, in a case that the nozzle hole is a straight hole, the fuel flow velocity reaches the acoustic velocity at an outlet of the nozzle hole. In other words, the fuel cannot be injected from the nozzle hole at the supersonic velocity.

(Issue 3)

In order to avoid the above Issue 2, it is considered that the nozzle hole is formed as Laval shape, which is not well known technology.

However, in the case that the needle lift amount is small, the fuel flow velocity is attenuated. Thus, even if the Laval shape is employed, the fuel flow velocity cannot reach the supersonic velocity.

JP-2012-145048A shows a fuel injection valve having a nozzle hole that is comprised of two tapered surfaces.

SUMMARY

It is an object of the present disclosure to provide a fuel injection nozzle which can inject the fuel at acoustic velocity or more even when a needle lift amount is large or small.

According to an aspect of the present disclosure, a shape between the nozzle seat surface and the needle tip portion downstream of the needle seat portion is defined by a Laval shape where a fuel fluid is accelerated to a supersonic velocity. Thereby, when the needle lift amount is small, the fuel flow velocity reaches an acoustic velocity in a valve opening portion, and then reaches a supersonic velocity by the Laval shape between the nozzle seat surface and the needle tip portion. Thus, it is restricted that the fuel flow velocity into the nozzle hole is attenuated.

In a case that the nozzle hole has the Laval shape, the fuel flow velocity reaches the supersonic velocity in the nozzle hole.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Embodiments of the present disclosure will be described hereinafter.

Referring to drawings, specific embodiments will be described. The present disclosure will be described with reference to embodiments thereof. It is to be understood that the disclosure is not limited to the embodiments and constructions.

First Embodiment

Figure 1A:
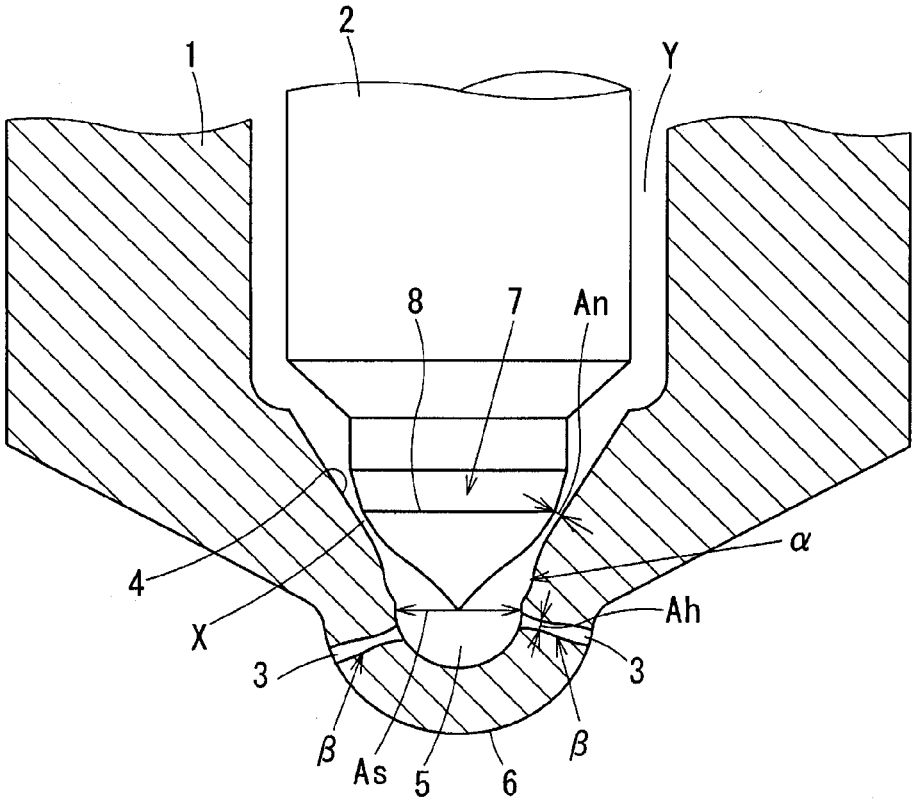
FIG. 1A is a cross sectional view showing a fuel injection nozzle according to a first embodiment.
Figure 1B:
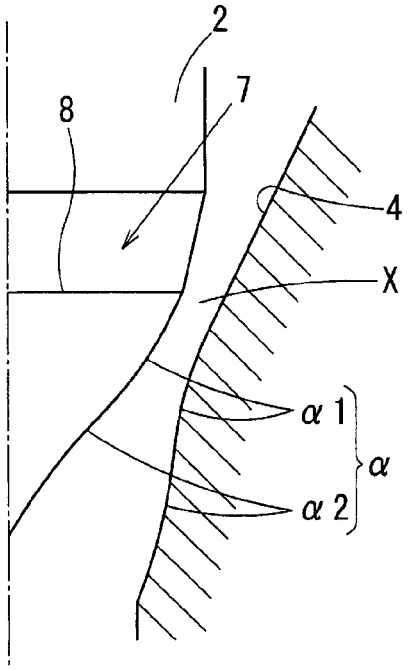
FIG. 1B is a cross sectional view showing Laval shape formed between a nozzle body and a needle according to the first embodiment.
Figure 2:
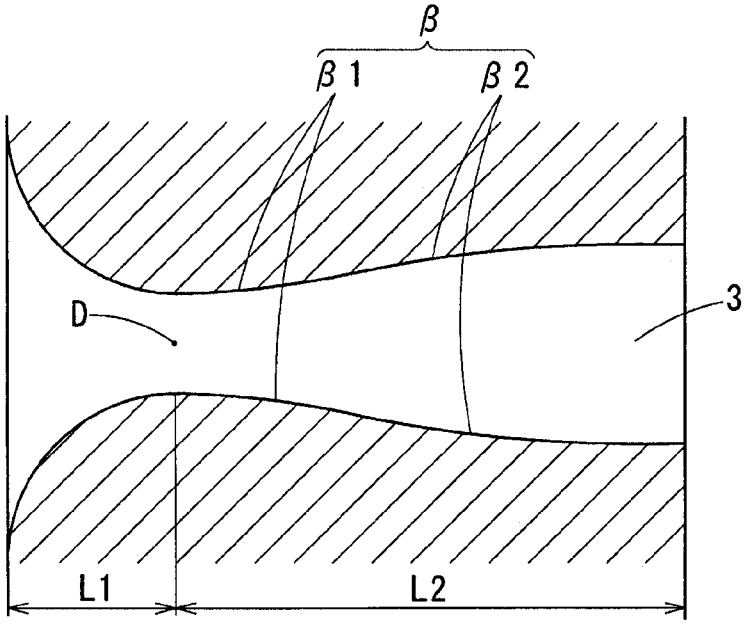
FIG. 2 is a cross-sectional view showing a shape of an injection hole according to the first embodiment.

Referring to FIGS. 1A, 1B and 2, a first embodiment will be described hereinafter. A fuel injection apparatus injects supercritical liquefied gas fuel into a cylinder of a compression ignition type engine. Specifically, the liquefied gas fuel is dimethyl ether (DME).

The fuel injection apparatus has a common-rail, a feed pump, a high-pressure pump, a fuel heater, a fuel injector, and control units (ECU, EDU). The common-rail is an accumulator accumulating high-pressure liquid phase DME supplied from the high-pressure pump. The accumulated high-pressure fuel is supplied to the fuel injector.

The feed pump is a low-pressure pump which suctions liquid-phase DME (for example, DME pressurized to around 10 atmospheres) in the fuel tank, and feeds the DME to the high-pressure pump. The high-pressure pump pressurizes liquid-phase DME to a predetermined pressure and feed the DME to the common-rail. The high-pressure pump includes a metering valve which adjusts the fuel feed quantity. Also, the common-rail has a pressure-reducing valve. The DME pressure in the common-rail is adjusted to the target pressure by the metering valve and the pressure-reducing valve.

The fuel heater is an electric heater provided to the common-rail, the injector, or the fuel pipe so that the liquid-phase DME is brought into the critical state. The energized state of the fuel heater is controlled by the control unit. If the fuel can be brought into the supercritical state by heat energy transmitted from the engine, the fuel heater is unnecessary.

When the fuel injector is energized, the fuel injector injects the DME into the cylinder. The fuel injector has a nozzle body 1 and a needle 2. The nozzle body 1 defined a space "Y" into which the pressurized fuel is introduced. Thee needle 2 reciprocates in the space "Y". The nozzle body 1 has an injection hole 3 which is opened/closed by the needle 2.

The needle 2 is driven by an electromagnetic actuator. Alternatively, the needle 2 is hydraulically driven.

The nozzle body 1 is fixed on the engine through an injector body. The nozzle body 1 defines a nozzle hole therein, which forms the space "Y".

At a bottom portion of the nozzle hole, a nozzle seat 4 is formed. The inner surface of the nozzle seat 4 is approximately conical shape. At a lower portion of the nozzle seat 4, a spherical sack chamber 5 is formed. Specifically, the nozzle body 1 has a spherical swelling portion 6. The spherical sack chamber 5 is formed in the spherical swelling portion 6.

A plurality of injection holes 3 are formed in the swelling portion 6. The injection hole 3 is a shaft hole which extends from an inner surface of the sack chamber 5 to an outer surface of the swelling portion 6. The injection hole 3 is formed by electric discharge machining. As shown in FIG. 2, the injection hole 3 has Laval shape β.

The Laval shape β is a reduction-expansion shape formed by curved surfaces, along which the fuel in the injection hole 3 is accelerated to supersonic velocity. In the present embodiment, the DME in supercritical state is accelerated to acoustic velocity in a minimum converging section D in the injection hole 3. Then, the DME is accelerated to supersonic velocity along the Laval shape β.

The internal shape of the injection hole 3 from the inlet to the minimum converging section D is referred to as a converging range L1, and the internal shape of the injection hole 3 from the minimum converging section D to the outlet is referred to as an expanding range L2.

The converging range L1 has single curvature radius and swells toward the center axis of the injection hole 3. The minimum converging section D has a convex surface which is connected to the converging range L1. The expanding range L2 has the Laval shape β. The Laval shape β is comprised of a convex curve surface β1 and a concave curve surface β2.

The Laval shape β provided in the injection hole 3 will be explained specifically.

The Laval shape β can be expressed by dimensional formula. Specifically, the Laval shape β of an injection hole 3 can be expressed by "$ax^3+bx^2+D/2$", wherein "$a<0$, $0<b$, and D is an inner diameter of the minimum converging section D."

In the following description, the Laval shape β portion will be referred to as an acceleration portion.

The needle 2 is slidably supported by the nozzle hole. At a lower end of the needle 2, a needle tip portion 7 is formed, which is comprised of a plurality of cones of which angles are different from each other. The needle tip portion 7 has two or more conic surfaces of which angles are different from each other. A boundary line between adjacent conic surfaces defines a needle seat portion (seat ring) 8 which sits on a nozzle seat surface 4. Specifically, a spreading angle above the needle seat portion 8 is smaller than that of the nozzle seat surface 4. The spreading angle below the needle seat portion 8 is greater than that of the nozzle seat surface 4.

The shape between the nozzle seat surface 4 and the needle tip portion 7 at a downstream of the needle seat portion 8 is defined by Laval shape α where the fluid is accelerated to the supersonic velocity.

The Laval shape α is a reduction-expansion shape formed by curved surfaces, along which the fuel flowing through a valve-opening portion X is accelerated to supersonic velocity. When the needle 2 is lifted a little, the valve-opening portion X functions as a throttle. The DME is accelerated to supersonic velocity along the Laval shape α.

The Laval shape α formed between a nozzle seat surface 4 and a needle tip portion 7 has a convex curve surface α1 and a concave curve surface α2. As shown in FIG. 1B, the convex curve surface α1 and the concave curve surface α2 are formed on the nozzle seat surface 4 and the needle tip portion 7. The convex curve surface α1 on the nozzle seat surface 4 confronts the convex curve surface α1 on the needle tip portion 7. The concave curve surface α2 on the nozzle seat surface 4 confronts the concave curve surface α2 on the needle tip portion 7.

As described above, the needle seat portion 8 is defined by the boundary line between adjacent of the conic surfaces on the needle tip portion 7. In the first embodiment, the convex curve surface α1 on the needle tip portion 7 is formed under the needle seat portion 8. That is, the needle seat portion 8 is a boundary line of conic surfaces, and the needle seat portion 8 does not overlap the convex curve surface α1.

The Laval shape α will be described more specifically.

The Laval shape α can be expressed by dimensional formula. Specifically, the Laval shape α can be expressed by "$ax^3+bx^2+X/2$", wherein "$a<0$, $0<b$, and X is a clearance distance of the valve-opening portion X."

In the following description, the Laval shape α portion will be referred to as a seat acceleration portion.

An operation of the fuel injection nozzle will be described hereinafter.

In the following descriptions, an opening area between the nozzle seat surface 4 and the needle tip portion 7, that is, an opening area of the valve-opening portion X is denoted by "An", a cross sectional area of the sack chamber 5 is denoted by "As", and a total passage sectional area of the injection holes 3 is denoted by "Ah".

When the needle 2 is fully lifted, it is defined as "Ah<An<As" or "Ah<As<An."

In the following descriptions, when "0<An≤Ah" is satisfied, it is defined that the needle 2 is at small lift. When "Ah<An" is satisfied, it is defined that the needle 2 is at large lift.

(At time of seating: 0=An)

When the fuel injector is deenergized, the needle seat portion 8 of the needle tip portion 7 sits on the nozzle seat surface 4, whereby the injection holes 3 are closed. The fuel injection is terminated.

(At time of small lift: 0<An≤Ah)

When the fuel injector is energized, the needle 2 is lifted up and the needle tip portion 7 moves away from the nozzle seat surface 4, so that the injection hole 3 is opened.

When the needle 2 is at small lift, the valve-opening portion X functions as a flow restriction. Then, the flow velocity of DME in the critical state reaches acoustic velocity in valve-opening portion X, and then reaches supersonic velocity at the seat acceleration portion in the Laval shape α. For this reason, even though the flow velocity is reduced in the sack chamber 5, the DME flows at acoustic velocity or more.

The DME is re-accelerated in the converging range L1. The DME reaches acoustic velocity in minimum converging section D, and reaches a supersonic velocity in the Laval shape β of an acceleration portion. For this reason, even though the needle 2 is at small lift, the DME can be injected at supersonic velocity.

(At time of large lift: Ah<An)

When the needle 2 is at large lift, the valve-opening portion X and the sack chamber function as a fluid passage. The fuel flow does not attenuate. The DME is accelerated in the converging range L1. The DME reaches acoustic velocity in minimum converging section D, and reaches a supersonic velocity in the Laval shape β of an acceleration portion. For this reason, even though the needle 2 is at large lift, the DME can be injected at supersonic velocity.

(First Advantage of First Embodiment)

According to the first embodiment, the fuel injection nozzle has the Laval shape α at the seat acceleration portion under the needle seat portion 8, as described above. Thereby, after the flow velocity of DME reaches acoustic velocity in the valve-opening portion X at the time of small lift, the flow velocity of DME flowing into the sack chamber 5 becomes supersonic velocity by means of the Laval shape α of the seat acceleration portion. Although the flow velocity of the DME is decreased, the decreasing rate of the flow velocity can be restricted to a small value. As a result, the DME flows into the injection hole 3 without reducing its flow velocity.

According to the first embodiment, the injection hole 3 has the Laval shape β at the acceleration portion. Thus, by increasing the pressure in the sack chamber 5 more than the cylinder pressure, the flow velocity of DME can be brought into the supersonic velocity in the injection hole 3 at both the time of small lift and large lift.

As above, in a range from the small lift to the large lift, the DME can be injected from the injection hole 3 at the supersonic velocity. The penetrating force of the injected fuel is increased, so that the DME fuel and the fresh air can be well mixed in the range from the small lift to the large lift.

(Second Advantage of First Embodiment)

In the above description, the DME in critical state flows into the seat acceleration portion. In the following description, it is assumed that the DME in liquid phase passes through the valve-opening portion X and flows into the seat acceleration portion. In this case, the cavitation generated under the valve-opening portion X can be extinguished by the Laval shape α in the seat acceleration portion. Thus, even if the pressure ratio between the upstream and the downstream of the valve-opening portion X is large, it can be restricted that the DME flow is choked. The actual mass flow rate of the DME flowing into the sack chamber 5 can be increased, so that the pressure recovery in the sack chamber 5 is expedited.

(Third Advantage of First Embodiment)

At the time of the large lift, as mentioned above, since the valve-opening portion X and the sack chamber 5 functions as the fuel passages, even if there is no Laval shape α in the seat acceleration portion, the DME fuel can be injected at the supersonic velocity. By providing the Laval shape α at the seat acceleration portion, the mass flow rate of the fuel flowing into the sack chamber 5 can be increased.

(Fourth Advantage of First Embodiment)

As described above, the convex curve surface α1 and the concave curve surface α2 are formed on the nozzle seat surface 4 and the needle tip portion 7. The convex curve surface α1 and the concave curve surface α2 are made as gentle curves. Thus, the DME fuel at the supercritical state can be smoothly accelerated to the supersonic velocity, without generating an impulse wave at the Laval shape α of the seat acceleration portion.

(Fifth Advantage of First Embodiment)

As described above, the needle seat portion 8 is defined by the boundary line between adjacent conic surfaces on the needle tip portion 7. The convex curve surface α1 on the needle tip portion 7 is formed under the needle seat portion 8. Since the needle seat portion 8 and the convex curve surface α1 do not overlap each other, the seating position accuracy of the needle 2 to the nozzle body 1 can be enhanced. As a result, the manufacturing cost of the fuel injection nozzle having the Laval shape α can be decreased.

Second Embodiment

Figure 3:
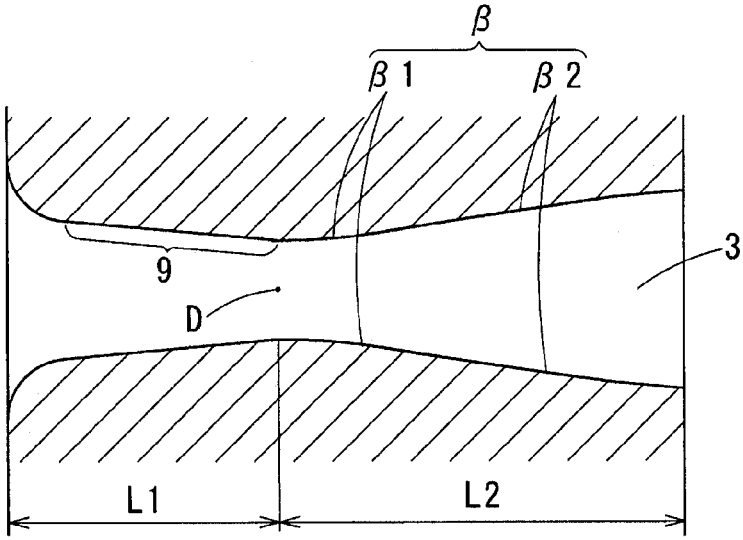
FIG. 3 is a cross-sectional view showing a shape of an injection hole according to the second embodiment.

A second embodiment is described with reference to FIG. 3. In the successive embodiments, the same parts and components as those in the first embodiments are indicated with the same reference numerals.

In the above first embodiment, the injection hole 3 has only the curved surface at upstream of the Laval shape β.

According to a second embodiment, the injection hole 3 has an assist surface 9 at upstream of the Laval shape β. The fuel velocity is accelerated on the assist surface 9. Specifically, the assist surface 9 is a tapered surface toward the Laval shape β.

The assist surface 9 is for accelerating the DME flow velocity to the acoustic velocity. In a case that the taper degree "K" is defined by "(Di−D0)/L1", it is preferable that "K"≈4. "Di" denotes an inner diameter of an inlet of the injection hole 3. "D0" denotes an inner diameter of the minimum converging section D. "L1" denotes a passage length of the converging range L1.

(First Advantage of Second Embodiment)

The assist surface 9 accelerates the DME flow velocity. The DME flow velocity is surely brought into the acoustic velocity.

(Second Advantage of Second Embodiment)

Even in a case that the DME fuel in liquid phase flows into the injection hole 3, the assist surface 9 accelerates the DME flow velocity.

(Third Advantage of Second Embodiment)

The combustion heat is transferred to the fuel through the assist surface 9. Even in a case that the DME fuel in liquid phase flows into the injection hole 3, the DME fuel is heated to be in the critical state. The DME fuel in the critical state can be accelerated to the supersonic velocity at the Laval shape β of the acceleration portion.

(Modification of Second Embodiment)

In the second embodiment, the Laval shape α is formed under the needle seat portion 8. However, the injection hole 3 may have the assist surface 9 and the Laval shape β in the acceleration portion without forming the Laval shape α. That is, the shape between the nozzle seat surface 4 and the needle tip portion 7 may be formed like a conventional fuel injection nozzle. The pressurized fuel can be accelerated by the assist surface 9. The fuel accelerated by the assist surface 9 flows into the Laval shape β to be supersonic velocity.

Third Embodiment

Figure 4:
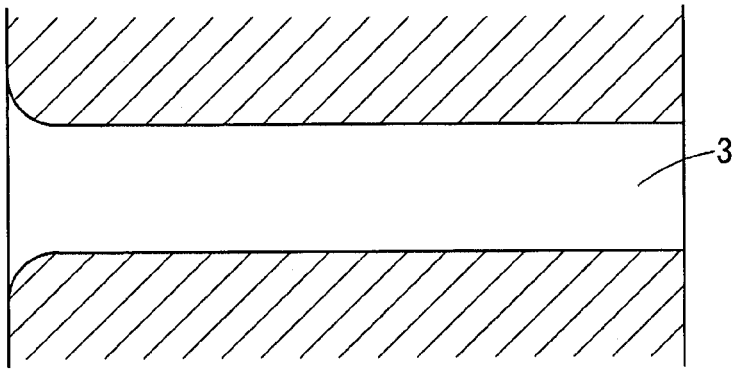
FIG. 4 is a cross-sectional view showing a shape of an injection hole according to the third embodiment.

Referring to FIG. 4, a third embodiment is described.

In the above first and second embodiments, the injection hole 3 has the Laval shape β at the acceleration portion. Meanwhile, according to the third embodiment, an inner diameter of the injection hole 3 is substantially constant. That is, the injection hole 3 is a straight hole.

(Advantage of Third Embodiment)

Since the injection hole 3 is a straight hole, the flow velocity of the DME fuel reaches acoustic velocity at an outlet of the injection hole 3. Thus, by increasing the pressure in the sack chamber 5 more than the cylinder pressure, the flow velocity of DME can be brought into the supersonic velocity in the injection hole 3 at both the time of small lift and large lift. Moreover, since the injection hole 3 is a straight hole, its manufacturing cost can be reduced.

Fourth Embodiment

Figure 5:
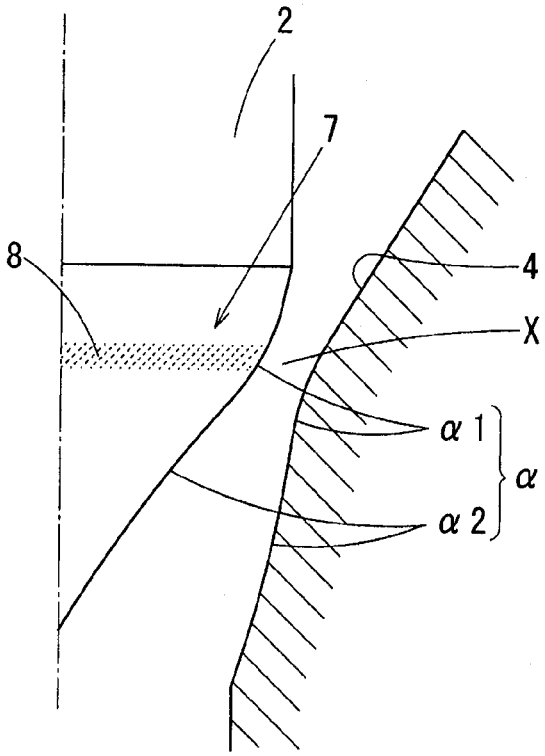
FIG. 5 is a cross sectional view showing Laval shape formed between a nozzle body and a needle according to the fourth embodiment.

A fourth embodiment is described with reference to FIG. 5. In the first embodiment, the convex curve surface α1 on the needle tip portion 7 is formed under the needle seat portion 8. According to the fourth embodiment, the needle seat portion 8 is formed by the convex curved surface α1/ having the Laval shape α. That is, the convex curved surface α1 of the needle tip portion 7 sits on the nozzle seat surface 4.

(Advantage of Fourth Embodiment)

Since the convex curved surface α1 sits on the needle seat portion 8, the contact pressure between the convex curved surface α1 and the needle seat portion 8 can be reduced. As the result, the abrasion resistance can be ensured.

Moreover, the seal efficiency between the convex curved surface α1 and the needle seat portion 8 can be enhanced.

Even if the abrasion wear is progressed, the seat diameter is enlarged and a valve opening timing is delayed. The fuel injection quantity is decreased. As a result, the engine output is reduced. It is avoided that the engine output becomes excessive.

Fifth Embodiment

Figure 6:
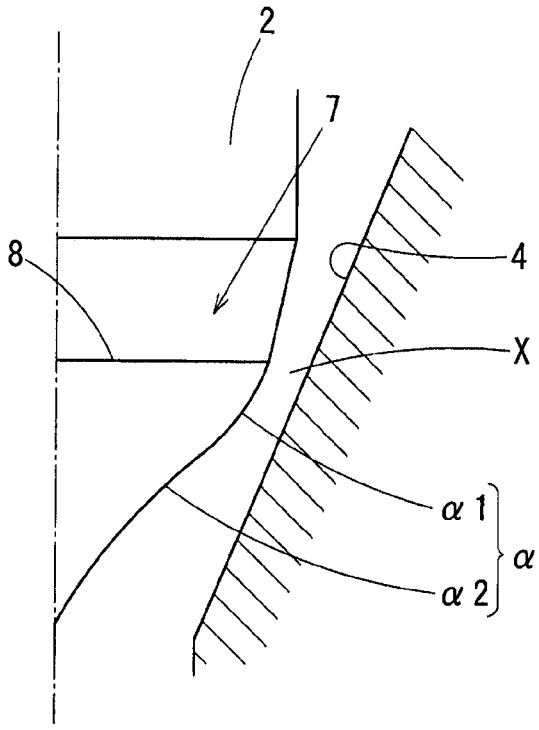
FIG. 6 is a cross sectional view showing Laval shape formed between a nozzle body and a needle according to the fifth embodiment.

A fifth embodiment is described with reference to FIG. 6.

In the above first embodiment, the convex curve surface α1 and the concave curve surface α2 are formed on the nozzle seat surface 4 and the needle tip portion 7. In the fifth embodiment, the convex curved surface α1 and the concave curved surface α2 are provided to only needle tip portion 7. The nozzle seat surface 4 is provided to the conic surface.

(Advantage of Fifth Embodiment)

It is unnecessary to form the convex curved surface α1 and the concave curved surface α2 on the nozzle seat surface 4. Thus, a manufacturing cost of the seat acceleration portion can be reduced.

Modification

The kind of fuel is not limited to DME. For example, methane, ethane, or propane may be used as the liquefied gas fuel.

The shape of the injection hole 3 is not limited to the above embodiments.

The injection hole 3 may be communicated with a portion downstream of the nozzle seat surface 4.

What is claimed is:

1. A fuel injection nozzle comprising:

a nozzle body defining a space which receives a pressurized fuel therein;

a needle reciprocating in the space; and an injection hole formed in the nozzle body, which is opened/closed by the needle; wherein the nozzle body has a nozzle seat surface on which the needle sits, the needle has a needle tip portion including a needle seat portion which sits on the nozzle seat surface, and a shape between the nozzle seat surface and the needle tip portion downstream of the needle seat portion is defined by a Laval shape where a fuel fluid is accelerated to a supersonic velocity.

2. A fuel injection nozzle according to claim 1, wherein an opening area between the nozzle seat surface and the needle tip portion is denoted by "An", a total passage sectional area of the injection hole is denoted by "Ah", when "0<An≤Ah" is satisfied, it is defined that the needle is at a small lift, and a shape between the nozzle seat surface and the needle tip portion downstream of the needle seat portion is defined by the Laval shape at least when the needle is at the small lift.

3. A fuel injection nozzle according to claim 1, wherein the Laval shape has a convex curved surface and a concave curved surface which are provided to both of the nozzle seat surface and the needle tip portion.

4. A fuel injection nozzle according to claim 1, wherein the Laval shape has a convex curved surface and a concave curved surface which are provided to only the needle tip portion, and the nozzle seat portion has a conic surface confronting the convex curved surface and the concave curved surface.

5. A fuel injection nozzle according to claim 1, wherein:

the needle seat portion is defined by a boundary line between adjacent conic surfaces on the needle tip portion, the Laval shape has a convex curved surface and a concave curved surface, and the convex curve surface is formed under the needle seat portion.

6. A fuel injection nozzle according to claim 1, wherein:

the needle seat portion has a convex curve surface, and the convex curve surface sits on the nozzle seat surface.

7. A fuel injection nozzle according to claim 1, wherein:

the injection hole has an inner surface which is formed as the Laval shape where a fuel flow velocity is accelerated to a supersonic velocity.

8. A fuel injection nozzle according to claim 7, wherein the injection hole further has an assist surface on which the fuel flow velocity is accelerated toward the Laval shape.

9. A fuel injection nozzle according to claim 1, wherein:

the injection hole is a straight hole of which inner diameter is constant.

* * * * *